United States Patent [19]

Shea

[11] 4,021,070

[45] May 3, 1977

[54] MECHANICAL LIFT

[76] Inventor: Frank Joseph Shea, 258 E. Shore Trail, Sparta, N.J. 07871

[22] Filed: Apr. 2, 1976

[21] Appl. No.: 673,253

[52] U.S. Cl. ..... 296/19; 214/77 P; 214/DIG. 10; 214/454

[51] Int. Cl.[2] ..... A61G 3/00; E02F 3/42

[58] Field of Search ..... 296/19; 214/77 R, 77 P, 214/454, 453, 451, 450, DIG. 10; 224/42.21, 42.44

[56] References Cited

UNITED STATES PATENTS

| | | | |
|---|---|---|---|
| 3,637,097 | 1/1972 | Horowitz | 214/DIG. 10 |
| 3,650,423 | 3/1972 | O'Brien | 214/DIG. 10 |
| 3,717,271 | 2/1973 | Bargman | 214/451 |

*Primary Examiner*—Philip Goodman
*Attorney, Agent, or Firm*—Frederick W. Padden

[57] ABSTRACT

Described is a mechanical lift for lifting (or lowering) an object to (or from) an elevated storage compartment. The lift comprises a carriage in which the object, for example an oxygen tank, is secured. Rigid bars are pivotally mounted to an upper portion of the carriage and to a lower portion (e.g., floor) of the compartment. Preferably, the bars are mounted on opposite sides of the carriage. A telescoping rod is pivotally connected to the upper portion of the carriage and to an upper portion (e.g., ceiling) of the compartment. Spring means, which extends between substantially the same points as the telescoping rod, counterbalance the weight of the object when it is being lowered out of or lifted into the compartment.

9 Claims, 4 Drawing Figures

MECHANICAL LIFT

BACKGROUND OF THE INVENTION

This invention relates to mechanical apparatus for lifting and lowering heavy objects from one level to another and, more particularly, to such apparatus for lifting and lowering oxygen tanks stored in elevated compartments of emergency vehicles.

Moving heavy objects by hand requires that special care be exercised in order to avoid physical strain, especially to the back. For many applications where large numbers of items are to be moved mechanical apparatus, such as fork lifts and the like, have been devised to facilitate moving boxes of goods, machinery, and other heavy objects. In the field of emergency first aid, however, heavy oxygen tanks are still manually lifted to and from elevated storage compartments in, for example, a van-like ambulance. Oxygen tanks are particularly heavy and, under such circumstances, present a twofold problem when being moved: physical strain to the ambulance personnel, particularly women, and the danger of explosion if the tank is dropped and oxygen leaks out.

Due to the limited funds of most first aid squads, expensive lifting machinery cannot be afforded. Moreover, commerically available machinery is generally unsuited to moving oxygen tanks in and out of storage compartments.

It is, therefore, a broad, general object of this invention to lift and lower heavy objects without undue physical strain.

It is a more specific object of this invention to safely lift and lower an oxygen tank from an elevated storage compartment of an emergency vehicle without the need for expensive machinery.

SUMMARY OF THE INVENTION

In accordance with an illustrative embodiment of the invention, an object to be lowered (or lifted) from (or to) an elevated storage compartment is secured to a carriage which partially surrounds the object. Rigid bars are pivotally mounted to an upper portion of the carriage and to a lower portion (e.g., floor) of the compartment. Preferably, the bars are mounted on opposite sides of the carriage. A telescoping rod is pivotally connected to the upper portion of the carriage and to an upper portion (e.g., ceiling) of the compartment. Spring means extend between substantially the same points as the telescoping rod.

When the object (e.g., an oxygen tank) is stored in the compartment, the base of the carriage rests on the floor of the compartment. Means, such as a suitable strap, secures the object and carriage into the compartment. In this position, the telescoping unit and springs are retracted and are oriented vertically near the back of the compartment. The rigid bars are also substantially vertical. When the object is to be lowered to the floor, for example when an oxygen tank is to be used in rescue efforts or simply when an empty tank is to be replaced, the securing means is released, the carriage is pulled forward out of the compartment so that the rigid bars rotate outwardly parallel to each other and at an angle to the ground. Simultaneously, the telescoping unit and the spring means extend as the object is lowered. Because most of the weight of the object is counterbalanced by the upward force of the stretched springs, heavy objects, such as one hundred-fifty pound oxygen tanks, appear to be lighter and can readily be lowered by even the slightest of personnel. The procesure is simply reversed in order to load the object into the elevated compartment.

BRIEF DESCRIPTION OF THE DRAWING

These and other objects of the invention, together with its various features and advantages, can be readily understood from the following more detailed description, in which.

DETAILED DESCRIPTION

Figure 1:
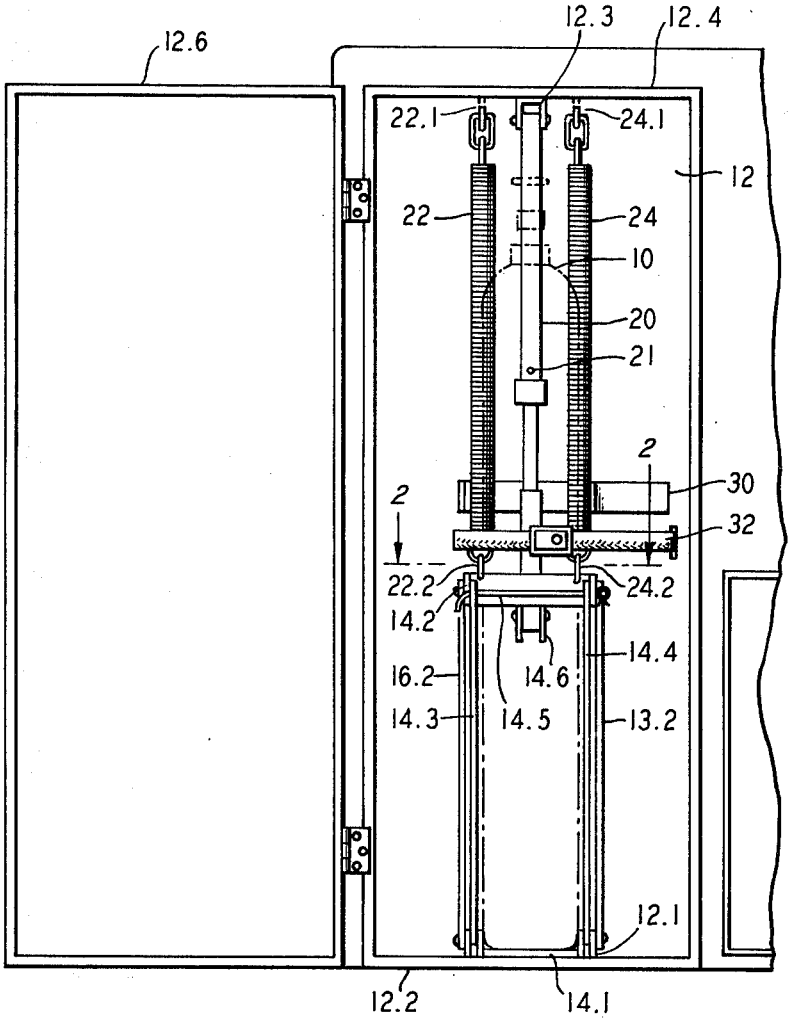
FIG. 1 is a front view of an illustrative embodiment of a mechanical lift in accordance with the invention looking into a storage compartment.

Turning now to the figures, there is shown a mechanical lift in accordance with an illustrative embodiment of the invention especially adapted for lifting (or lowering) an oxygen tank 10 to (or from) an elevated storage compartment 12. In van-like ambulances, the compartment 12 is typically formed in a rearward exterior portion of the ambulance wall.

The tank 10 is secured in a metal carriage 14 formed by a base 14.1 on which the tank 10 rests, a U-shaped horizontal bar 14.2 opens toward the front of the compartment, and a pair of verical bars 14.3 and 14.4 which are rigidly connected between base 14.1 and U-shaped bar 14.2 The bars 14.3 and 14.4 are connected to opposite sides of U-shaped bar 14.2 and, hence, on opposite sides of tank 10. A slidably removable lock rod 14.5 extends across the open end of U-shaped bar 14.2 in order to prevent tank 10 from falling out of carriage 14. To this end, rod 14.5 is inserted through opposite holes in the ends of bar 14.2

A pair of rigid metal bars 16.1 and 16.2 of equal length are pivotally connected to an upper portion of carriage 14 (i.e., to one side of U-shaped bar 14.2) and to a lower portion of compartment 12 (i.e., to pivot frame 12.1 mounted on floor 12.2). A similar pair of bars 18.1 and 18.2 are pivotally connected in the same manner on the opposite side of bar 14.2.

A telescoping unit 20 is pivotally connected to an upper portion of carriage 14 (i.e., to hinge 14.6 on the back of U-shaped bar 14.2) and to an upper portion of compartment 12 (i.e., to hinge 12.3 mounted on ceiling 12.4). Spring means extend between substantially the same points as telescoping unit 20. That is, springs 22 and 24 are mounted on opposite sides of U-shaped bar 14.2; spring 22 is hooked between eye 22.1 in ceiling 12.4 and bar 14.2 at 22.2; and spring 24 is hooked between eye 24.1 and bar 14.2 at 24.2.

Figure 2:
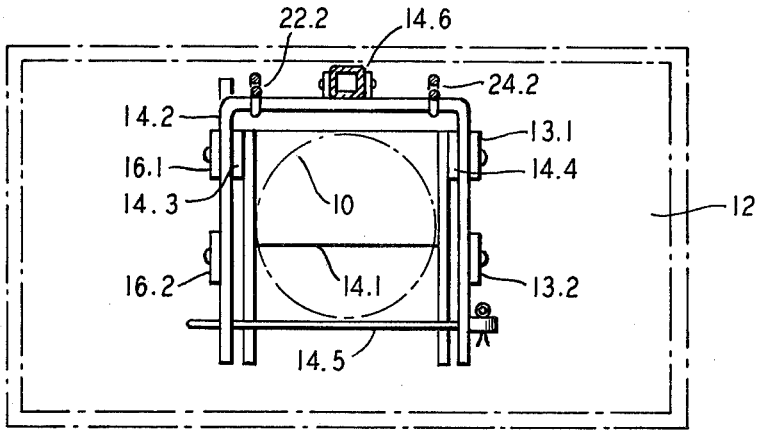
FIG. 2 is an enlarged plan view looking down at line 2—2 of FIG. 1.
Figure 3:
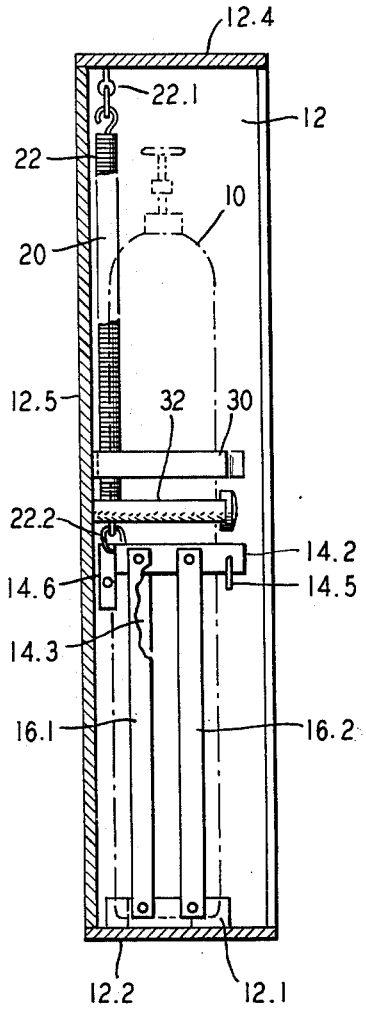
FIG. 3 is a side view of FIG. 1.

When the tank 10 is stored in compartment 12, as shown in FIGS. 1–3, the base 14.1 of carriage 14 rests on the floor 12.2 (i.e., in pivot frame 12.1). In this position, bars 16.1, 16.2, 18.1 and 18.2, telescoping unit 20 and springs 22 and 24 are oriented vertically. The upper part of tank 10 then rests between the extended arms of U-shaped guide bar 30 mounted on the back wall 12.5 of compartment 10. Guide bar 30 and bars 16.1, etc., cooperate to keep tank 10 from tipping sideways in the compartment. Strap 32, which is also mounted on back wall 12.5, is secured around the tank 10 in order to prevent the tank 10 and carriage 14 from falling forward against door 12.6 of compartment 12.

Figure 4:
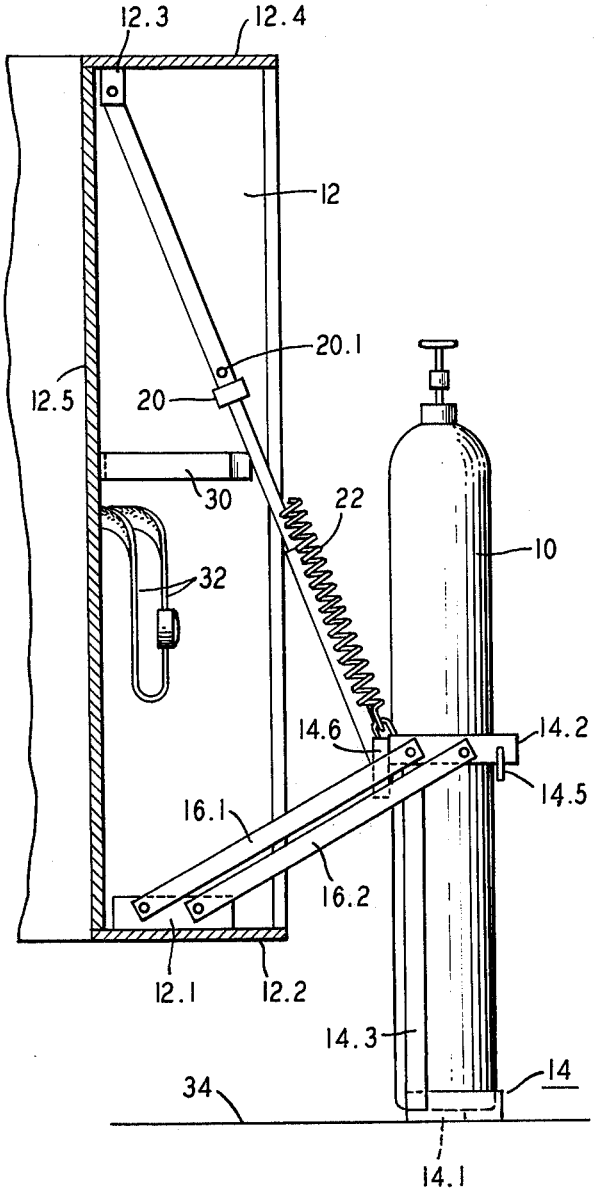
FIG. 4 is a side view of an illustrative embodiment of the invention showing the position of various components when the mechanical lift is operated to lower an oxygen tank to ground level.

In order to remove the tank 10 from compartment 12, as shown in FIG. 4, the door 12.6 is opened, strap 32 is released and the carriage 14 is pulled forward. This action causes bars 16.1, etc., to rotate forward parallel to each other and at an angle to the ground. Simuntaneously, telescoping unit 20 extends, acting as a guide, and springs 22 and 24 stretch to counterbalance the weight of tank 10 as it is lowered to the ground floor 34. Unit 20 is extended until locking pin 20.1 snaps into place. Once on the floor, lock rod 14.5 is slid out of U-shaped bar 14.2 and the tank is removed for use or replaced if empty. To return the tank to the compartment, the above procedure is simply reversed.

The counterbalancing effect of springs 22 and 24 cooperates with the guiding effect of bars 16.1, etc, and telescoping unit 20 to reduce considerably the physical strain and other dangers attendant the handling of heavy objects, succh as oxygen tanks. Consequently, even those who lack physical strength or dexterity can readily operate the mechanical lift to move heavy objects.

It is to be understood that the above-described arrangements are merely illustrative of the many possible specific embodiments which can be devised to represent application of the principles of the invention. Numerous and varied other arrangements can be devised in accordance with these principles by those skilled in the art without departing from the spirit and scope of the invention.

What is claimed is:

1. A mechanical lift for lifting (or lowering) an object to (or from) an elevated compartment comprising a carriage in which said object can be removably secured, rigid bar means pivotally connected to an upper portion of said carriage and to a lower portion of said compartment for guiding said carriage when being moved, elongated telescoping means pivotally connected to an upper portion of said carriage and to an upper portion of said compartment for further guiding said carriage when being moved, and means connected between said carriage and an upper portion of said compartment for counterbalancing the weight of said object when being moved.

2. A lift according to claim 1 wherein said carriage comprises, a base on which the bottom of said object rests, a U-shaped bar having its open end facing outwardly of said compartment, said U-shaped bar forming said upper portion of said carriage and being adapted to permit said object to extend therethrough, means rigidly connecting said base and said U-shaped bar in shaped relation to one another, and means removably positioned across the open end of said U-shaped bar for preventing said object from falling out of said carriage.

3. A lift according to claim 2 wherein said rigid bar means comprises first and second pairs of bars of equal length pivotally connected to the floor of said compartment and to said U-shaped bar, said pairs being located on opposite sides of said carriage.

4. A lift according to claim 3 wherein said counterbalancing means comprises a pair of springs connected between said upper portion of said compartment and a backward portion of said U-shaped bar, said springs being substantially identical and being connected to points near to opposite sides of said U-shaped bar.

5. A lift according to claim 4 wherein said telescoping means comprises an elongated telescoping rod pivotally connected to said upper portion of said compartment and to said backward portion of said U-shaped bar, said telescoping rod being positioned between said springs, and a releasable locking pin for locking said rod into an extended position.

6. A lift according to claim 5 further including a pair of outwardly directed guide members connected to the rear wall of said compartment, said guide members being spaced to receive said object and to prevent said object from tipping sideways, and strap means connected to said rear wall for securing said object in said compartment.

7. A mechanical lift for lifting (or lowering) an oxygen tank and the like to (or from) a elevated compartment in an emergency vehicle comprising a carriage in which said tank can be removably secured, said carriage comprising a base on which the bottom of said tank rests, a U-shaped bar having its open end facing outwardly of said compartment and being adapted to permit said tank to extend therethrough, means rigidly connecting said base and said U-shaped bar in spaced relation to one another, and means removably positioned across the open end of said U-shaped bar for preventing said tank from falling out of said carriage, first and second pairs of bars of equal length pivotally connected to the floor of said compartment and to said U-shaped bar, said pairs being located on opposite sides of said U-shaped bar, an elongated telescoping rod pivotally connected to an upper portion of said compartment and a backward portion of said U-shaped bar, a releasable pin for locking said rod into an extended position, and means connected between said backward portion of said U-shaped bar and an upper portion of said compartment for counterbalancing the weight of said tank when being moved comprising a pair of substantially identical springs located on opposite sides of said telescoping rod.

8. A lift according to claim 7 further including a pivot frame mounted on the floor of said compartment, said pairs of bars having one end thereof pivotally connected to said frame, said frame being adapted to receive said base when said tank is stored in said compartment.

9. A lift according to claim 8 further including a pair of outwardly directed guide members connected to the rear wall of said compartment, said guide members being spaced to receive said tank and to prevent said tank from tipping sideways, and strap means connected to said rear wall for securing said tank in said compartment.

* * * * *